US010773293B2

(12) United States Patent
Weyland

(10) Patent No.: US 10,773,293 B2
(45) Date of Patent: Sep. 15, 2020

(54) HYDRAULIC PUNCH DEVICE

(71) Applicant: TKR Spezialwerkzeuge GmbH, Gevelsberg (DE)

(72) Inventor: Thorsten Weyland, Herdecke (DE)

(73) Assignee: TKR Spezialwerkzeuge GmbH, Gevelsberg (DE)

( * ) Notice: Subject to any disclaimer, the term of this patent is extended or adjusted under 35 U.S.C. 154(b) by 0 days.

(21) Appl. No.: 16/156,561

(22) Filed: Oct. 10, 2018

(65) Prior Publication Data

US 2019/0111464 A1 Apr. 18, 2019

(30) Foreign Application Priority Data

Oct. 12, 2017 (DE) ..... 10 2017 123 723

(51) Int. Cl.

| | |
|---|---|
| ***B21D 28/26*** | (2006.01) |
| ***B21D 28/34*** | (2006.01) |
| ***B21D 28/24*** | (2006.01) |
| ***B21D 37/04*** | (2006.01) |

(52) U.S. Cl.

CPC ..... *B21D 28/26* (2013.01); *B21D 28/243* (2013.01); *B21D 28/34* (2013.01); *B21D 37/04* (2013.01)

(58) Field of Classification Search

CPC ..... B21D 28/26; B21D 28/34; B21D 37/04; B21D 28/243; B21D 45/006; B21D 45/003; B26D 7/2614; B26D 2007/1809; B26D 7/18; B26F 1/14

USPC ..... 83/686, 639; 30/368, 362, 358, 130

See application file for complete search history.

(56) References Cited

U.S. PATENT DOCUMENTS

| | | | | | |
|---|---|---|---|---|---|
| 667,258 | A * | 2/1901 | Sloat | B21D 28/243 | 30/361 |
| 2,357,306 | A * | 9/1944 | Benner | B21D 28/243 | 30/361 |
| 2,536,709 | A * | 1/1951 | Ashton | B21D 28/002 | 30/361 |
| 3,137,193 | A * | 6/1964 | Whistler | B21D 28/34 | 83/685 |
| 3,211,035 | A | 10/1965 | Whistler, Sr. | | |
| 3,335,627 | A | 8/1967 | Smelts | | |
| 4,667,411 | A | 5/1987 | McCallum | | |
| 5,070,616 | A * | 12/1991 | Chen | B26D 3/169 | 30/180 |
| 5,081,891 | A * | 1/1992 | Johnson | B21D 45/006 | 83/140 |

(Continued)

FOREIGN PATENT DOCUMENTS

| | | |
|---|---|---|
| DE | 1911840 U | 3/1965 |
| DE | 102015112724 A1 | 2/2017 |

(Continued)

OTHER PUBLICATIONS

European Search Report for Application No. EP 18196871.0, dated Feb. 27, 2019, in German (8 pages).

*Primary Examiner* — Ghassem Alie
(74) *Attorney, Agent, or Firm* — Nixon Peabody LLP

(57) ABSTRACT

The invention relates to a hydraulic punch device with a hydraulically driven punch carrier for releasably seating a punch and a die with a die opening adapted to the punch cross-section of the punch. To provide a punch device that makes it possible to reliably produce differently shaped holes, the punch has a punch cross-section different from a circular cross-section.

9 Claims, 5 Drawing Sheets

(56) References Cited

U.S. PATENT DOCUMENTS

| | | | | |
|---|---|---|---|---|
| 6,367,362 | B1 * | 4/2002 | Brazell | B21D 28/243 83/518 |
| 2007/0028737 | A1 * | 2/2007 | Moellering | B21D 45/006 83/143 |
| 2010/0031797 | A1 * | 2/2010 | Peters | B21D 26/035 83/684 |
| 2010/0095815 | A1 * | 4/2010 | Laib | B21D 45/003 83/23 |
| 2010/0199819 | A1 * | 8/2010 | Okamoto | B21D 45/003 83/24 |

FOREIGN PATENT DOCUMENTS

| | | | |
|---|---|---|---|
| DE | 102015116560 | A1 | 3/2017 |
| DE | 102015116562 | A1 | 3/2017 |
| DE | 102015225569 | A1 | 6/2017 |
| EP | 2316588 | A2 | 5/2011 |
| EP | 3150297 | A1 | 4/2017 |
| WO | WO 2017/021363 | A2 | 2/2017 |

* cited by examiner

HYDRAULIC PUNCH DEVICE

This application claims the benefit of Germany Patent Application No. 10 2017 123 723.2, filed Oct. 12, 2017, which is incorporated herein by reference in its entirety.

The invention relates to a hydraulic punch device having:

a hydraulically driven punch carrier for releasably seating a punch, and a die with a die opening adapted to the punch cross-section of the punch.

Punch devices of the initially cited type are used to introduce holes into one or more pieces of sheet metal in a punching process which then serve to seat suitable connecting elements such as blind rivets, blind rivet screws and/or blind rivet nuts.

To produce holes, the pieces of sheet metal to be processed are arranged in the punch device between the punch and the die so that a hole selected corresponding to the punch can then be punched into the piece of sheet metal, wherein the punch is adjusted in the direction of the die for this purpose.

Presently known hydraulic punch devices are only designed to seat punches with a circular cross-section with which thus exclusively circular holes can be produced, wherein their diameter is determined by the diameter of the punching section of the punch. In order to produce different holes, the punches are in this case releasably arranged on a punch carrier of a piston unit of a hydraulic unit, wherein the piston unit can be moved in the direction of its longitudinal axis by a drive of the hydraulic unit and thereby drives the punch through the pieces of sheet metal to be processed.

To produce holes with a cross-section differing from a circular shape, for example to produce hexagonal seating openings to seat suitable nuts, at present, corresponding recesses are cut out of the sheet metal in cumbersome processes. The known production methods in this regard also have the disadvantage that the holes only have an inadequate shape.

Against this background, the object of the invention is to provide a punch device that makes it possible to reliably produce differently shaped holes.

The invention achieves the object with a hydraulic punch device having the features of claim 1. Advantageous further embodiments of the invention are specified in the dependent claims.

It is characteristic of the hydraulic punch device that the punch, which can be exchangeably arranged on the punch carrier, has a punch cross-section different from a circular cross-section.

The option of arranging punches that have cross-sections that differ from a circular cross-section, i.e., a cross-section deviating from a circular shape, for example in the shape of a slot, makes it possible to reliably produce holes as repeatedly as desired with an unchanging quality. Accordingly for example by using punches with a hexagonal punch cross-section, a recess for a nut can be reliably produced that then makes it possible to produce a twist-proof connection. The cross-sectional shape of the punch perpendicular to its longitudinal axis that corresponds to the punch cross-section is in principle freely selectable in this case, whereby differently designed holes can be reliably produced by punching, wherein the die assigned to the punch has a die opening corresponding to the punch cross-section.

To ensure a reliable alignment of the holes producible with the different punches, it is necessary, in contrast to circular punch cross-sections, to align the punch in a circumferential direction relative to the workpiece to be punched, such as sheet metal, in order to ensure a proper orientation of the opening to be produced, such as a slot.

In order to prevent a rotation of the punch during the punching process that changes the orientation of the punch, a further embodiment of the invention provides that the hydraulic punch device has a punch guide unit with a guide element that at least sectionally abuts the outside of the punch such that the punch is secured against rotation.

According to this embodiment of the invention, a punch guide unit is arranged, e.g. releasably fastened, on the hydraulic punch device. The punch guide unit prevents the punch from twisting during the punching process, such as from a rotation of the drive piston of the piston unit. The guide element supported on the punch device via the punch guide unit abuts, at least sectionally, an outer side of the punch running parallel to the adjusting direction of the punch so that twisting of the punch is prevented by the cross-sectional shape of the punch that differs from a circular shape. The punch can accordingly be easily aligned by a punch device user by aligning the punch device. After alignment, an adjustment of the position of the punch in a circumferential direction is reliably prevented due to the grip of the punch guide unit. The punch guide unit arranged in the region between the punch carrier and the die moreover prevents a radial displacement of the punch during the punching process.

The embodiment of the punch guide unit that can for example be releasably arranged on the hydraulic punch device is in principle freely selectable like the embodiment of the guide element. In its simplest embodiment, the guide element can be formed by a seating opening on the punch guide unit adapted to the punch cross-section. However, given the arrangement of the punch guide unit in the region between the punch carrier and die, the guide unit causes a reduction of the stroke movement of the punch. Therefore, according to an advantageous further embodiment of the invention, it is provided that the guide element is movably mounted in the adjusting direction of the punch on a seating unit of the punch guide unit.

According to this embodiment of the invention, the punch guide unit has a seating unit on which the guide element guiding the punch is movably mounted. The mobility of the guide element makes it possible in this case to avoid a reduction of the stroke by the arrangement of the punch guide unit in the region between the punch carrier and the die. The punch is guided in this case through the guide element. Moreover, after an axial stop of a stop surface of the punch that runs in the region of the punch carrier, the punch displaces the guide element in the direction toward the die during the punching process. For its part, the guide element in this case is guided on the seating unit of the punch guide unit so that the guide element simultaneously effectuates a reliable rotation lock of the punch over the entire range of the stroke.

Both in the case of a rigid guide element as well as in the case of a guide element that is movably arranged in the adjustment direction of the punch, the guide element has the advantage that it also serves in addition to a rotation lock as a scraper, which ensures that workpiece material from the lateral surface of the punch is reliably removed from it when the punch returns.

The arrangement of the guide element on the seating unit is freely selectable in principle. According to a particularly advantageous embodiment of the invention it is, however, provided that the guide element is biased toward the punch carrier, in particular spring-biased.

A bias of the guide element toward the punch carrier when it is movably mounted on the seating unit ensures that the guide element is reliably guided during the entire punching process. After a position of the punch is reached during the punching process in which a punch stop surface abuts the guide element, the guide element is moved opposite the spring bias toward the die, wherein the guide element continues to reliably guide the punch. After the punch returns, the guide element independently reaches its home position due to its spring bias. To generate the bias, any spring elements can be used in principle, in particular tension springs.

The embodiment of the seating unit and die carrier of the punch guide unit is in principle freely selectable. They can thus for example be designed as separate elements that can be individually arranged on the hydraulic punch device. According to a particularly advantageous embodiment of the invention, the seating unit and the die carrier are however designed as a single-part basic carrier. According to this embodiment of the invention, the seating unit for seating the guide element and the die carrier for seating the die are designed as a single part. A corresponding embodiment enables a particularly easy arrangement of the punch guide unit on the hydraulic punch device, wherein to do this, only the basic carrier of the punch guide unit must be connected to the punch device, for example to a punch yoke.

In this regard, for example the die carrier can be supported by a yoke end opposite the punch carrier or be screwed thereto so that the seating unit is reliably arranged between the punch carrier and the die. An alternative or supplementary positional fixation of the basic carrier of the punch guide unit can for example be achieved by additional securing legs that can be fastened on the one hand to the basic carrier and on the other hand to the punch yoke.

According to another embodiment of the invention it is provided that the seating unit has a seating opening for exchangeably arranging the guide element, and/or the die carrier has a die seat for exchangeably arranging a die.

According to this embodiment of the invention, it is possible to use the guide unit with different punches while using a standardized seating unit and a standardized die carrier. In case another punch cross-section is needed, it is only necessary to exchange the punch and the die and not the entire guide unit. Only the guide element and the die must be exchanged, wherein guide elements and dies adapted to the employed punch are arranged in the seating opening or respectively die seat. This embodiment of the invention enables particularly economical operation since a punch guide unit designed according to this development can be used with a plurality of punches.

Given the releasable arrangement of the punch guide unit on the punch device, it is easily feasible to mount the punch guide unit, exchange the punch guide unit which may be required and/or remove it when the hydraulic unit is to be operated with punches with a circular punch cross-section, wherein according to a particularly advantageous embodiment of the invention, the basic carrier is designed to releasably connect to a punch yoke of the punch device. Connecting to the punch yoke can be realized economically very easily.

Particularly reliable support during the punching process is achieved in particular in that, according to an advantageous further embodiment of the invention, the die carrier is designed to contact the punch yoke on its side opposite the die seat. This ensures a reliable transmission of force from the die seat to the punch yoke during the punching process.

Moreover, according to a particularly advantageous embodiment of the invention, the basic carrier has a contact section for arranging a workpiece in the region between the seating unit and the die carrier in the case of the embodiment provided according to an advantageous development according to which the seating unit and the die carrier are designed as a single-part basic carrier.

According to this embodiment of the invention, the contact section can for example be formed by a longitudinal groove that is open on one side and accordingly enables reliable arrangement of a workpiece to be punched in the region between the die carrier and the seating unit. In this case, the contact section ensures favorable positioning since it can also be used to support the workpiece to be punched.

An exemplary embodiment of the invention will be explained below with reference to the drawings. In the drawings.

Figure 1:
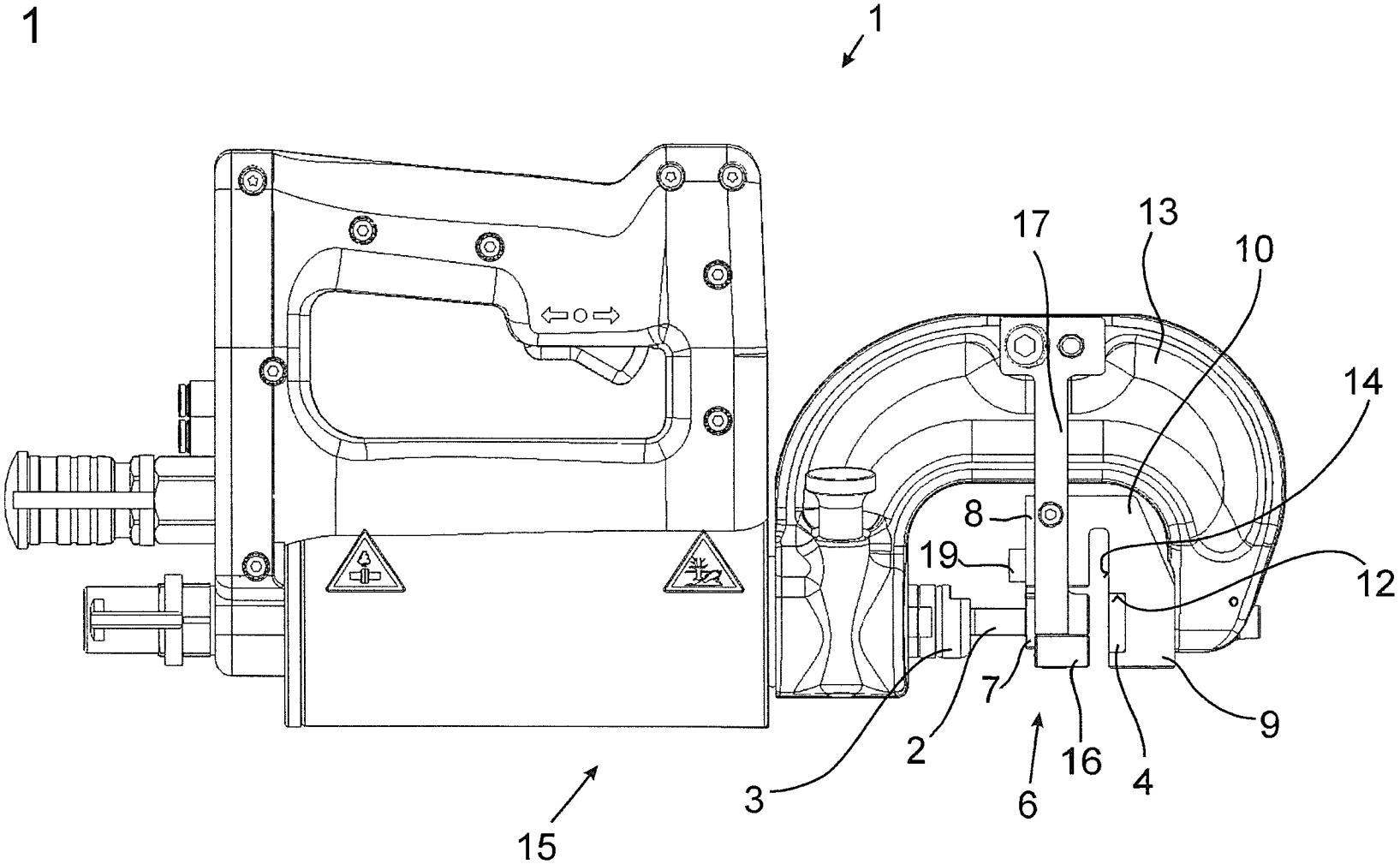
FIG. 1 shows a side view of an embodiment of a hydraulic punch device with a hydraulic unit and a punch yoke.
Figure 2:
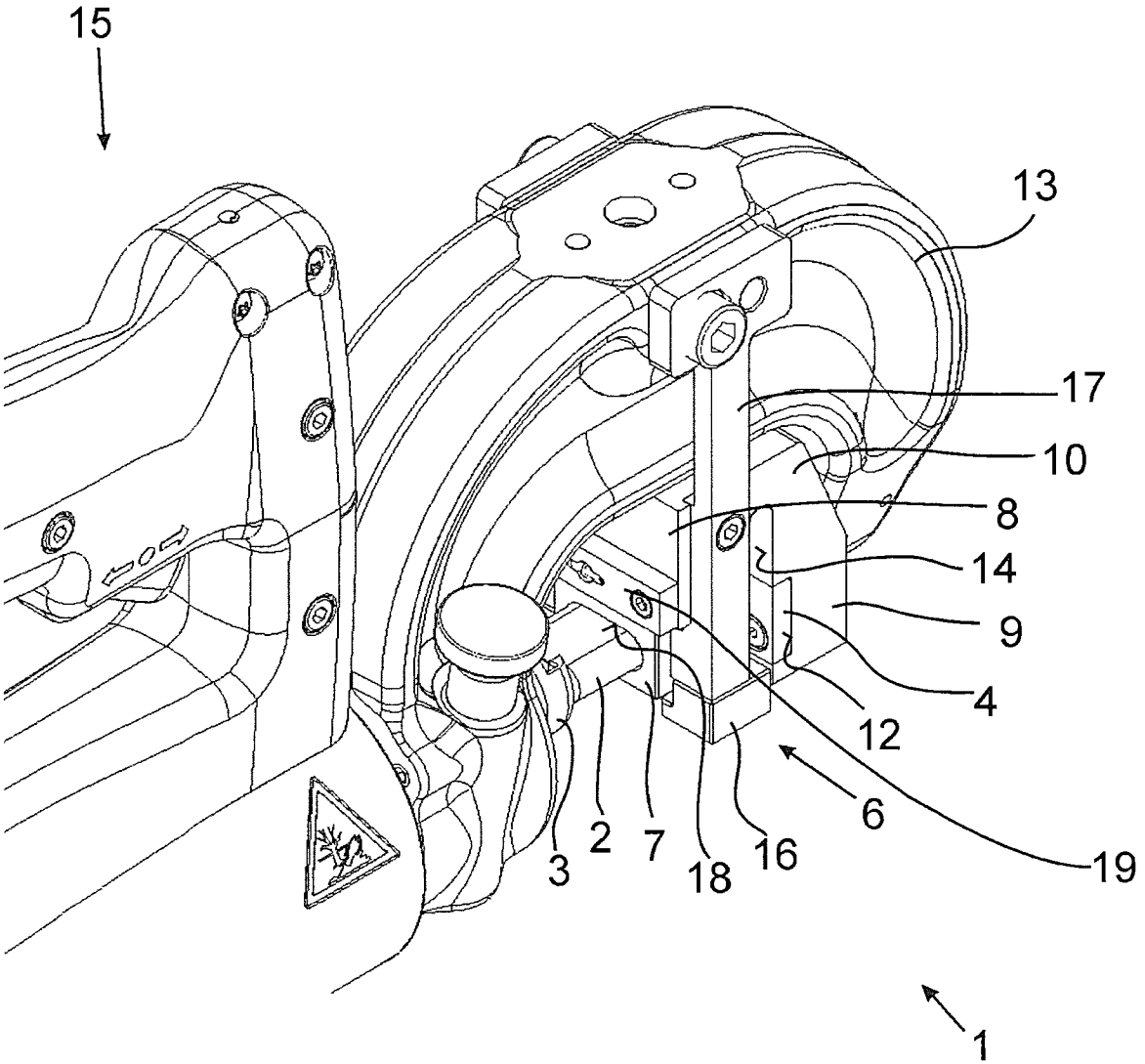
FIG. 2 shows a perspective view of the punch yoke region of the punch device from FIG. 1.
Figure 3:
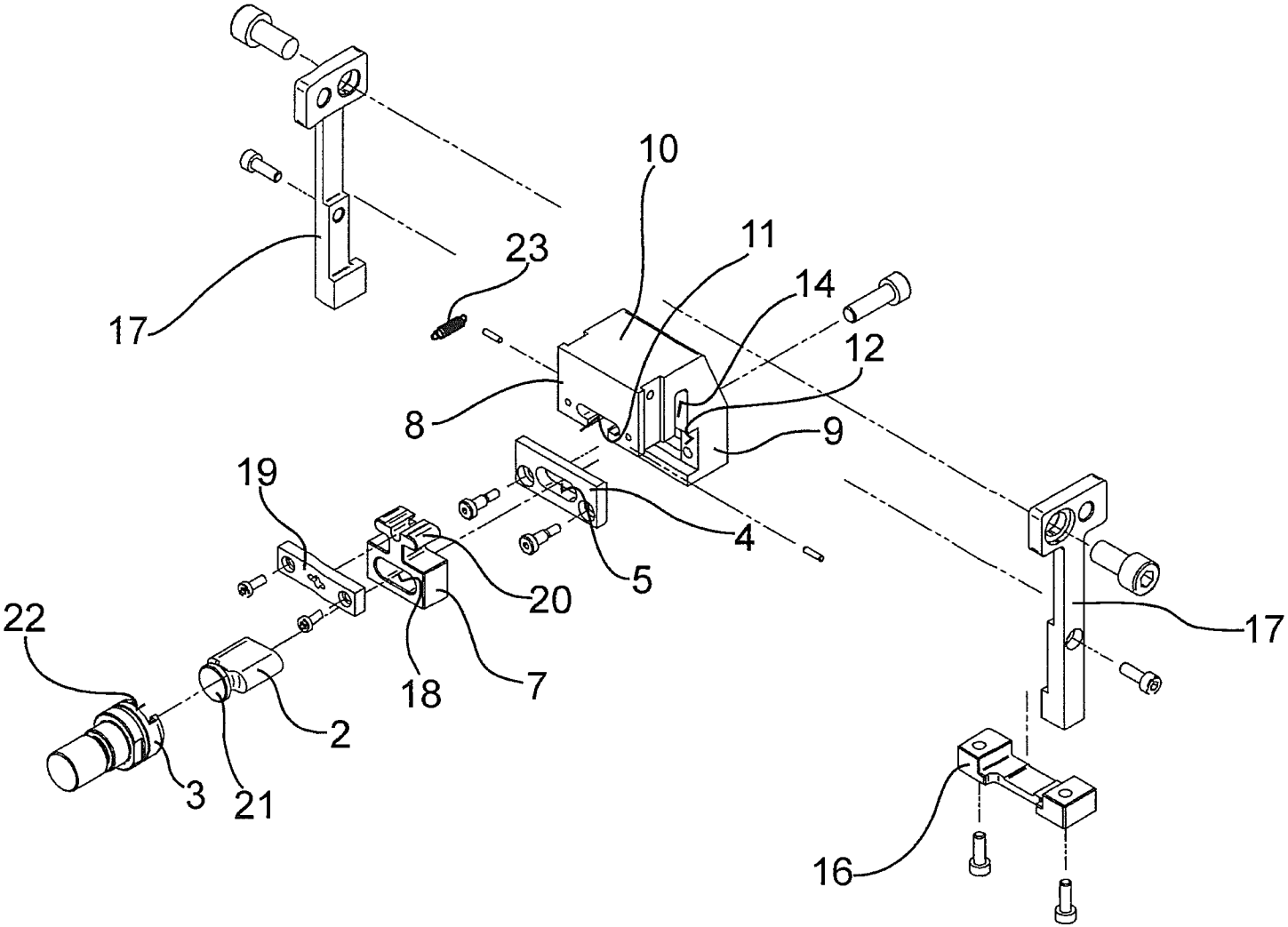
FIG. 3 shows an exploded view of a punch guide unit from FIG. 1.

The punch device 1 shown in a side view in FIG. 1 has a hydraulic unit 15 as well as a punch yoke 13 connected to the hydraulic unit 15. A piston of the hydraulic unit 15 (not shown) makes it possible to adjust toward a die 4 a punch carrier 3 for punching in the direction of the longitudinal axis of a punch 2 arranged on the punch carrier 3. By means of the punch device 1, it is accordingly possible to provide workpieces arrangeable in the region between the punch 2 and the die 4, such as pieces of sheet metal, with holes. The punch 2 is arranged with a connecting pin 21 in a punch seat 22 of the punch carrier 3 (see FIG. 1 to 3).

The punch carrier 3 is designed to releasably seat the punch 2, wherein it does not have a circular cross-section but rather a punch cross-section that can produce a slot. In this context, the punch 2 is additionally guided on its perimeter by a guide element 7 of a punch guide unit 6, wherein a guide section 18 of the guide element 7 abuts an outer surface of the punch 2. The guide element 7 accordingly prevents the punch 2 from twisting during the punching process and ensures an unchanging alignment of the punch 2 relative to the punch yoke 13.

Figure 4:
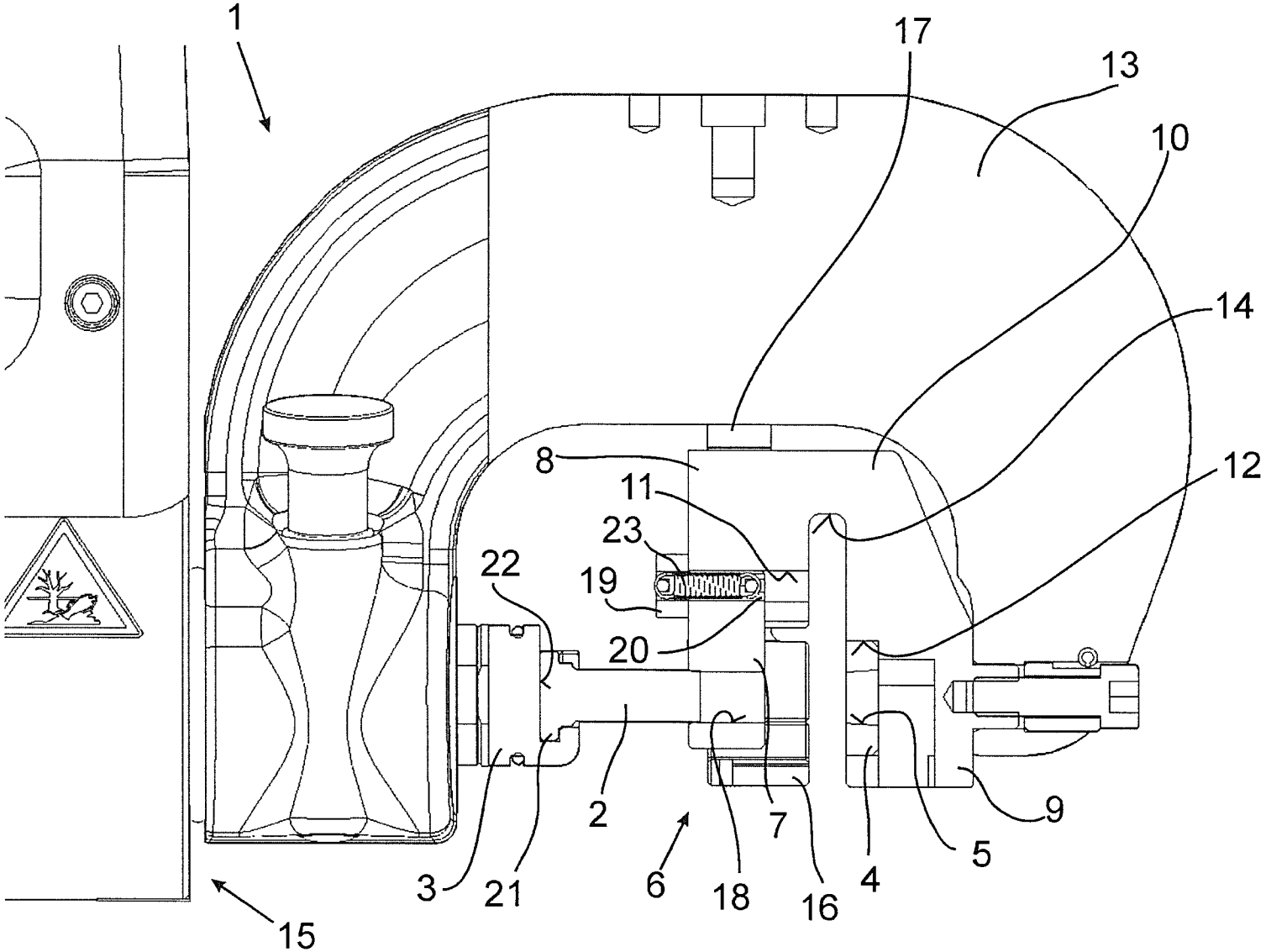
FIG. 4 shows a side view of the yoke region of the punch device from FIG. 1, partially in a section in a home position of the punch.

For its part, the guide element 7 is arranged movably in the direction of the longitudinal axis of the punch 2 on a seating unit 8, wherein the seating unit 8 has a seating opening 11 for this purpose that is adapted to a guide element 20 of the guide element 7. In the event that the punch 2 moves longitudinally during a punching process starting from the home position shown in FIG. 4 to the end position shown in FIG. 5, a shoulder of the punch 2 running in the region of the punch carrier 3 comes to rest on a face of the guide element 7 facing the punch carrier 3 and then moves it in the seating opening 11 toward a die carrier 9 that has a die seat 12 for arranging a die 4 that is adapted to the punch 2 and has a die opening 5 corresponding to the punch cross-section.

Figure 5:
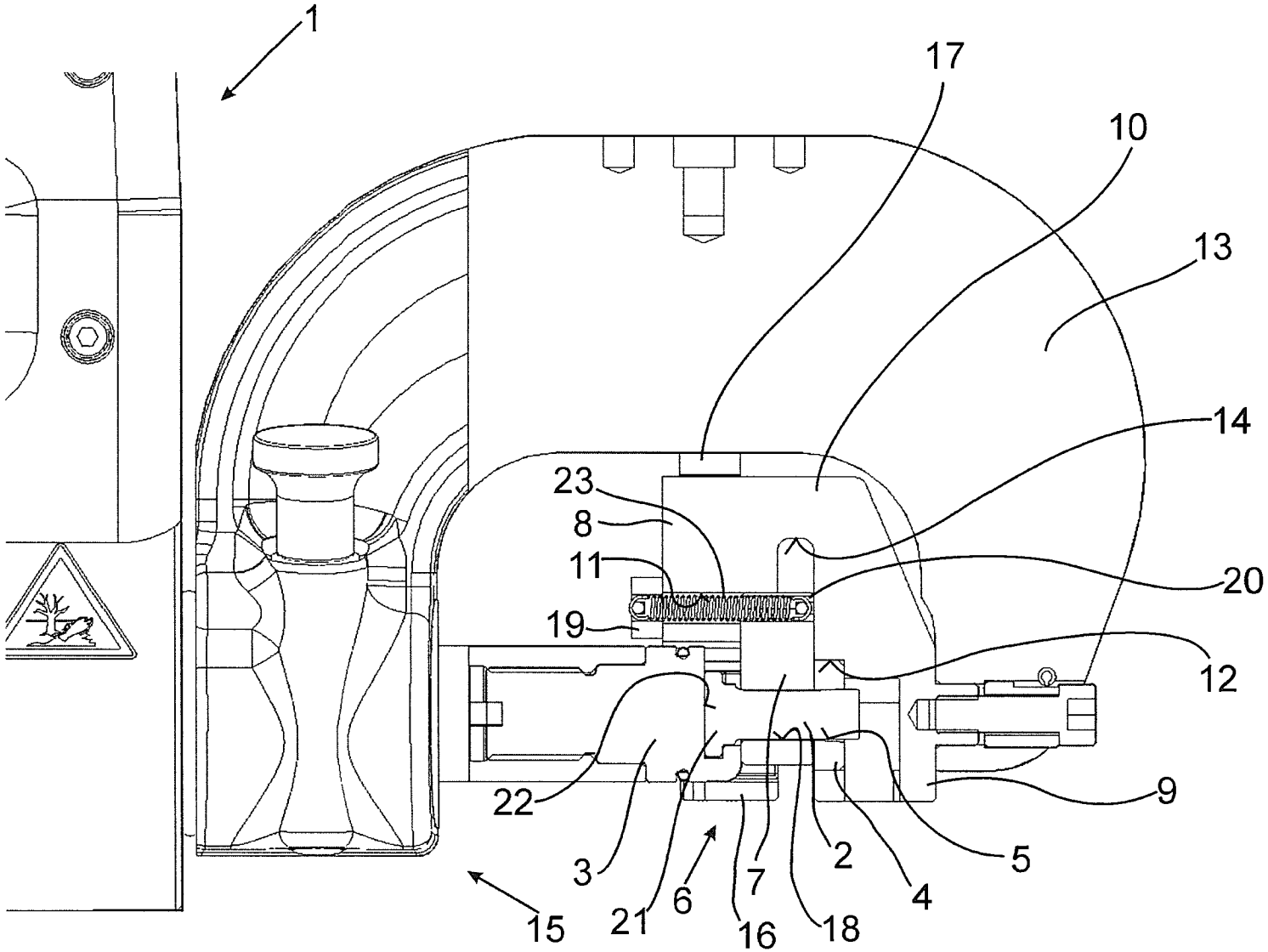
FIG. 5 shows a side view of the yoke region of the punch device from FIG. 1, partially in a section in an extended position of the punch.

In the end position shown in FIG. 5, the punch 2 extends with its punch cross-section through the die opening 5 of the die 4. When the punch 2 returns toward the home position shown in FIG. 4, the guide element 7 also reaches its home position, wherein it comes to rest in the home position on a cover plate 19 screwed on in the region of the seating unit 8 viewed in the direction toward the punch carrier 3. Given the positional fixation of the guide element 7 relative to the punch 2, it also serves as a scraper during the return movement.

The seating unit 8 and the die carrier 9 of the punch guide unit 6 are a component of a one-piece basic carrier 10 that has an elongated contact section 14 for arranging a workpiece in the region between the die 4 and the punch 2. In the region of die carrier 9, the basic carrier 10 is screwed to an end of the punch yoke 13 opposite the punch carrier 3. The position of the basic carrier 10 of the punch guide unit 6 on the punch yoke 13 is additionally fixed by two securing legs 17 adjoining the outside of the punch yoke 13 and screwed thereto. On their ends opposite the punch yoke, the securing legs 17 are also screwed to a retaining bar 16. Together with a section of the seating unit 8 and sections of the securing legs 17, this forms an opening for the guide element 7.

In this case, the guide element 7 is biased toward the punch carrier 3 by spring elements 23, which contact the cover plate 19 at one end and the guide element 7 at the other end.

REFERENCE SIGN LIST

1 Punch device
2 Punch
3 Punch carrier
4 Die
5 Die opening
6 Punch guide unit
7 Guide element
8 Seating unit
9 Die carrier
10 Basic carrier
11 Seating opening
12 Die seat
13 Punch yoke
14 Contact section
15 Hydraulic unit
16 Retaining bar
17 Securing leg
18 Guide section
19 Cover plate
20 Guide element
21 Connecting pin
22 Punch seat
23 Spring element

The invention claimed is:

1. A hydraulic punch device comprising:

a hydraulically driven punch carrier for releasably seating a punch, a die with a die opening corresponding to a cross-section of the punch, a punch guide unit with a guide element, wherein the cross-section of the punch is different from a circular cross-section, the guide element is arranged on the hydraulic punch device in a region between the punch carrier and the die wherein the guide element is supported on the punch device via the punch guide unit that at least sectionally abuts an outside of the punch such that the punch is secured against rotation, the guide element is mounted movably in the adjusting direction of the punch on a seating unit of the punch guide unit, and the seating unit and a die carrier are designed as a single-part basic carrier, and the basic carrier is designed to releasably connect to a punch yoke, wherein the single-part basic carrier is located within a space within the punch yoke.

2. The hydraulic punch device according to claim 1, wherein the guide element is biased toward the punch carrier.

3. The hydraulic punch device according to claim 2, wherein the guide element is spring-biased.

4. The hydraulic punch device according to claim 1, wherein the seating unit has a seating opening for exchangeably arranging the guide element, and/or the die carrier has a die seat for exchangeably arranging a die.

5. The hydraulic punch device according to claim 1, wherein the die carrier is designed to contact the punch yoke on a side of the die carrier side opposite the die seat.

6. The hydraulic punch device according to claim 1, wherein the single-part carrier has a contact section for arranging a workpiece in the region between the seating unit and the die carrier.

7. The hydraulic punch device according to claim 1, wherein the guide element is mounted movably in an adjusting direction of the punch on a seating unit of the punch guide unit.

8. A hydraulic punch device comprising:

a punch that is releasably arranged on a punch carrier of a piston unit of a hydraulic unit, wherein the piston unit can be moved in the direction of the piston unit's longitudinal axis by a drive of the hydraulic unit, thereby adjusting the punch carrier and the punch toward a die, wherein the punch has a non-circular cross-section, and the die has a die opening adapted to the cross-section of the punch, and wherein the punch has a punch guide unit with a guide element that is releasably fastened on the hydraulic punch device in a region between the punch carrier and the die, wherein the guide element is supported on the punch device via the punch guide unit, that is mounted movably in the adjusting direction of the punch on a seating unit of the punch guide unit, and that at least sectionally abuts the outside of the punch such that the punch is secured against rotation resulting from a rotation of the drive piston of the piston unit, wherein the seating unit and a die carrier are designed as a single-part basic carrier, the basic carrier being designed to releasably connect to a punch yoke, wherein the single-part basic carrier is located within a space within the punch yoke.

9. A hydraulic punch device comprising:

a punch that is releasably arranged on a punch carrier of a piston unit of a hydraulic unit, wherein the piston unit can be moved in a direction of the piston unit's longitudinal axis by a drive of the hydraulic unit, thereby adjusting the punch carrier and the punch toward a die, wherein the punch has a cross-section different from a circular cross-section, and the die has a die opening that corresponds to the cross-section of the punch, and wherein the punch has a punch guide unit with a guide element that is releasably fastened on the hydraulic punch device in a region between the punch carrier and the die, wherein the guide element is supported on the punch device via the punch guide unit, and that at least sectionally abuts the outside of the punch such that the punch is secured against rotation, the guide element being mounted movably in an adjusting direction of the punch on a seating unit of the punch guide unit, the seating unit and the die carrier being designed as a single-part carrier, the single-part carrier being designed to releasably connect to a punch yoke, wherein the single-part carrier is located within a space within the punch yoke, and the single-part carrier having a contact section for arranging a workpiece in a region between the seating unit and the die carrier.

* * * * *